United States Patent [19]

Owen

[11] Patent Number: 4,859,198

[45] Date of Patent: Aug. 22, 1989

[54] CONTACT ASSEMBLY

[75] Inventor: Alex F. Owen, Spring Creek, Pa.

[73] Assignee: GTE Products Corporation, Stamford, Conn.

[21] Appl. No.: 236,486

[22] Filed: Aug. 25, 1988

[51] Int. Cl.[4] ..... H01R 13/11

[52] U.S. Cl. ..... 439/252; 439/852; 439/857

[58] Field of Search ..... 439/252, 851, 852, 856, 439/857, 858, 65, 78

[56] References Cited

U.S. PATENT DOCUMENTS

| | | | |
|---|---|---|---|
| 3,853,389 | 12/1974 | Occhipinti | 439/852 X |
| 4,685,886 | 8/1987 | Denlinger et al. | 439/856 X |
| 4,776,651 | 10/1988 | Paulo | 639/857 |

FOREIGN PATENT DOCUMENTS

| | | | |
|---|---|---|---|
| 2390029 | 12/1978 | France | 439/851 |
| 1435587 | 5/1976 | United Kingdom | 439/851 |

*Primary Examiner*—Eugene F. Desmond
*Attorney, Agent, or Firm*—William H. McNeil

[57] ABSTRACT

A contact assembly for electrically conductively engaging large numbers of electrical connections between printed circuit boards. A plurality of pins mounted on one board are mated to a plurality of corresponding contacts mounted on another board, such contacts being contained in cavities extending along respective axes in a housing such that when the pins are fully engaged by the corresponding contacts each contact is substantially concentric relative to a corresponding axis and pin, and when the pins are not fully engaged by the corresponding contacts each contact extends at an angle relative to a corresponding axis.

15 Claims, 4 Drawing Sheets

CONTACT ASSEMBLY

BACKGROUND OF THE INVENTION

1. Field of the Invention

The present invention relates to a contact assembly including a plurality of elongated contacts for use in electronic systems requiring large numbers of electrical connections between printed circuit boards.

2. Description of the Prior Art

The need for a contact which is useful in systems requiring large numbers of electrical connections between printed wiring boards, known also as printed circuit boards, is well known. One problem incurred heretofore in attempting to make such connections is that of pin misalignment which can occur as a result of undesirable tolerance variation. Another problem is the inability to maintain contact normal force when variation in pin thickness occurs. Further, in assembling contacts into their associated housing, current practice is for the contacts to be pressed into an insulator to perfect an interference fit between contact and housing to hold the contact in place. This procedure compounds the problems noted regarding pin misalignment and thickness variability at least to the extent that such firmly held contacts provide very little, if any, compensation for misaligned pins and those having variable thickness.

It is highly desirable to provide a contact assembly which compensates for tolerance variation to thereby substantially reduce, if not eliminate, pin misalignment.

It is also desirable to provide a contact assembly which allows the maintaining of contact normal force notwithstanding any variation in pin thickness.

It is further desirable to provide a contact assembly which can be assembled without the need for an interference fit between each contact and its associated housing.

SUMMARY OF THE INVENTION

This invention achieves these and other results by providing a contact assembly for electrically conductively engaging first pins at one end of the contact assembly and second pins at an opposite end of the contact assembly. The contact assembly comprises a housing having a plurality of elongated cavities extending therethrough from one end to the opposite end, each cavity extending along a respective longitudinal axis and being formed by at least one sidewall. An elongated contact extends within respective select elongated cavities of the plurality of elongated cavites along a respective longitudinal axis. Each elongated contact comprises a bridging member having a first end spring biased towards the longitudinal axis and first means and second means for electrically conductively engaging first and second pins, respectively. The first means extends from the first end of the bridging member for electrically conductively engaging a respective first pin so that when the respective first pin is fully engaged by the first means the first means is substantially concentric relative to the longitudinal axis and the respective first pin, and when the respective first pin is not fully engaged by the first means the first means extends at an angle relative to the longitudinal axis. The second means extends from a second end of the bridging member for electrically conductively engaging a respective second pin.

DESCRIPTION OF THE PREFERRED EMBODIMENT

Figure 1:
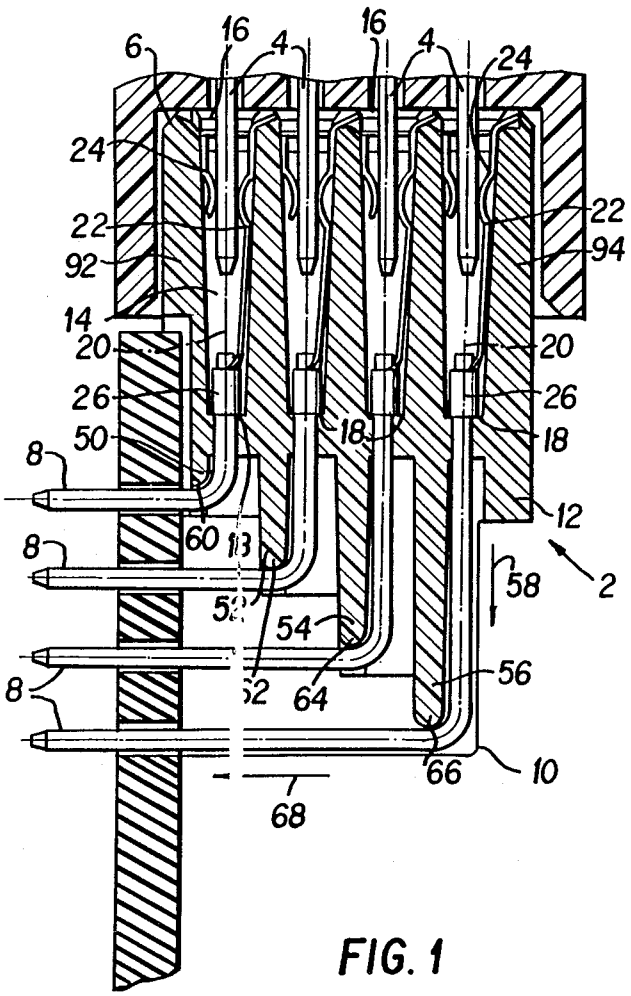
FIG. 1 is a sectional view of the contact assembly of the present invention.

The embodiment of this invention which is illustrated in the drawings is particularly suited for achieving the objects of this invention. FIG. 1 depicts a contact assembly 2 for electrically conductively engaging first pins 4 at one end 6 of the contact assembly and second pins 8 at an opposite end 10 of the contact assembly. The contact assembly 2 comprises a receptacle in the form of housing 12 having at least one elongated cavity 14 therein for receiving a first pin 4 at a first entrance 16 to cavity 14 and a second pin 8 at an opposite second entrance 18 to cavity 14. Each cavity 14 extends along a respective longitudinal axis 20.

An elongated contact 22 extends within select of the elongated cavities 14 along axis 20 for electrically conductively engaging a respective first pin 4 at end 24 of the contact and a respective second pin 8 at an opposite end 26 of the contact. First pins 4 mounted on a first circuit board (not shown) and encased in a plastic housing as depicted in FIGS. 1 to 3, are mated with a second circuit board by means of the receptacle in the form of housing 12, elongated contacts 22 and second pins 8 electrically conductively coupled thereto as depicted in FIG. 1.

The elongated contact 22 will now be described referring to FIG. 2, which is an enlargement of a portion of FIG. 1 with first pins 4 inserted in respective contacts 22, and FIG. 3, which is a corresponding enlargement of FIG. 1 but with first pins 4 having been withdrawn from respective contacts 22. Elongated contact 22 includes a bridging member 28, and first means 30 and second means 32 for electrically conductively engaging first and second pins 4 and 8, respectively. First means 30 extends from a first end 34 of the bridging member 28 for electrically conductively engaging a first pin 4 so that as depicted in FIG. 2 when a first pin 4 is fully engaged by the first means 30, the first means 30 is substantially concentric relative to the longitudinal axis 20 and first pin 4. By way of comparison, as depicted in FIG. 3, when the first pin 4 is not fully engaged by the first means 30, as when the first pin 4 has been withdrawn from the contact assembly 2, the first means 30 extends at an angle relative to axis 20. Second means 32 extends from a second end 36 of bridging member 28.

Figure 2:
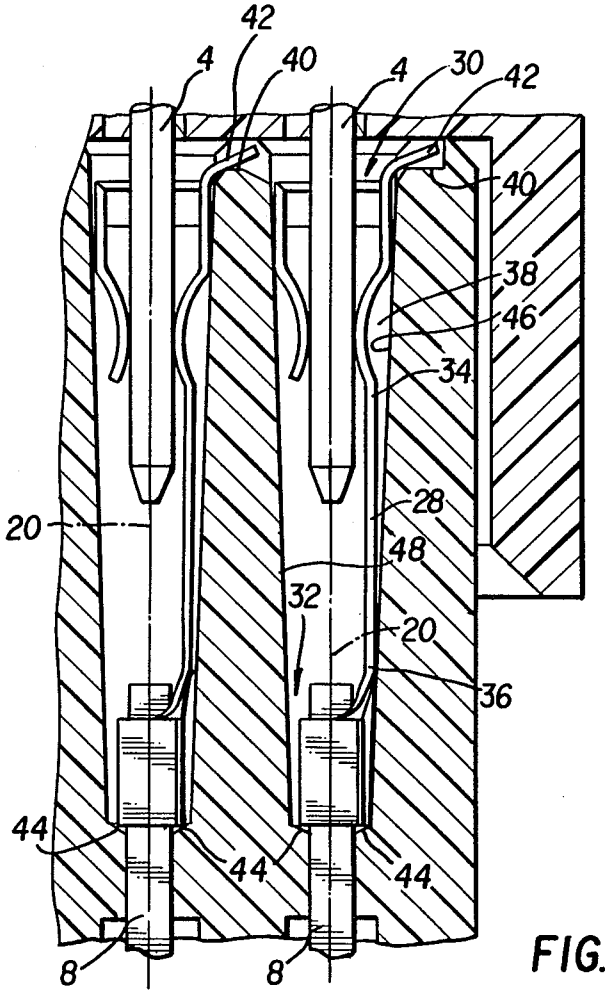
FIG. 2 is an enlarged sectional view of a portion of the contact assembly of FIG. 1 having two sets of pins inserted therein.
Figure 3:
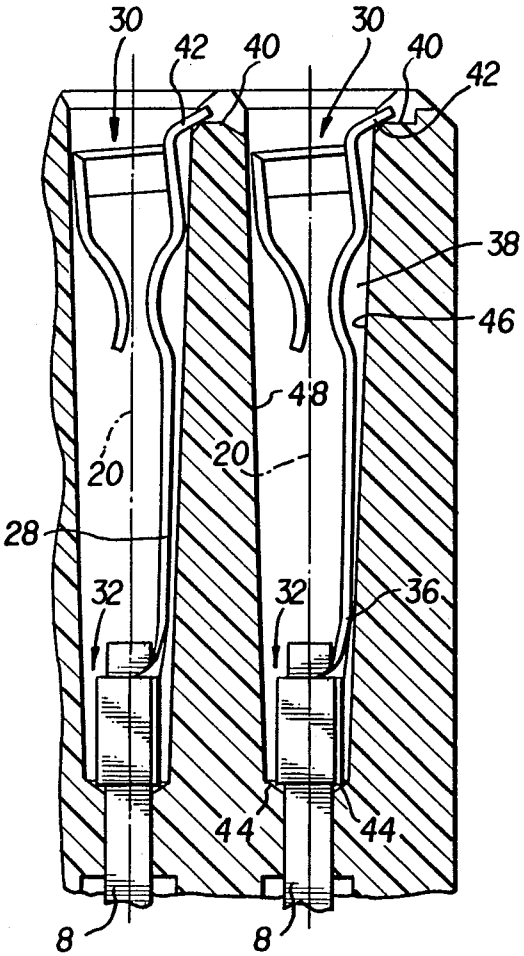
FIG. 3 is an enlarged sectional view of a portion of the contact assembly of FIG. 1 having one set of pins inserted therein.

In the embodiment depicted in FIGS. 1 to 3 each cavity 14 includes a sidewall 38 which includes a first shoulder 40 at a first entrance 16. Similarly, each elongated contact 22 includes a flange 42 at end 24 thereof. Flange 42 is moveable relative to first shoulder 40, the flange being shown in a first position in FIG. 2 which depicts first pins 4 inserted into the contact assembly 2, and a second position in FIG. 3 which depicts first pins 4 withdrawn from the contact assembly 2. In this manner, as noted above when a respective first pin is fully engaged by first means 30, first means 30 is substantially concentric relative to axis 20 and first pin 4, and when a respective first pin is not fully engaged by first means 30, first means 30 extends at an angle relative to axis 20.

In the preferred embodiment sidewall 38 includes a second shoulder 44 at second entrance 18 and each second means 32 rests upon a respective shoulder 44.

Cavity 14 can be in the form of a truncated four sided pyramid in which case sidewall 38 will include a plurality of opposite facing surfaces as depicted in FIGS. 1 to 3. For example, FIGS. 1 to 3 depict two of such opposite facing surfaces 46, 48 extending from first entrance 16 towards second entrance 18 at an angle relative to axis 20. In such an embodiment the surface 46 will includes a first shoulder 40, and at least two surfaces 46 and 48 will include a second shoulder 44.

In the preferred embodiment, housing 12 includes extended portions 50, 52, 54 and 56 each of which extends from the housing at a respective second entrance 18. In such embodiment, as depicted in FIG. 1 second pins 8 are electrically conductively attached to a respective second means 32, and each second pin 8 extends out of a respective cavity 14 at a respective second entrance 18 in a first direction 58 along axis 20, is bent at a respective end 60, 62, 64 and 66 of extended portions 50, 52, 54 and 56, respectfully, and extends in a second direction 68, which is at an angle to the axis 20 through apertures in the second printed circuit board. In this manner each second pin 8 holds the contact 22 to which it is attached in place within a respective cavity 14. In other words, during assembly, each contact can be dropped into a respective housing cavity and secured by a tail bending operation rather than providing an interference fit between contact and cavity wall by pressing the contacts into respective cavities as is presently the practice.

Figure 4:
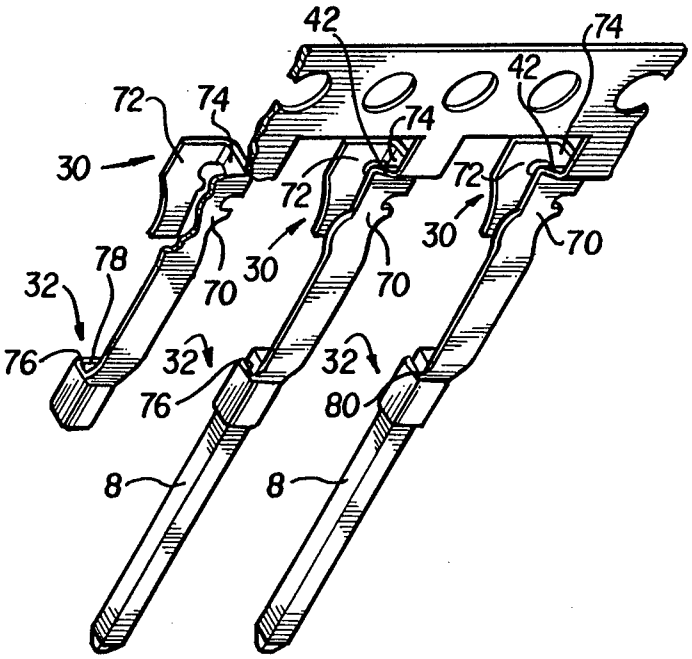
FIG. 4 is a partial perspective view of the elongated contacts of the contact assembly of FIG. 1.

Referring to FIG. 4, the first means 30 includes a U-shaped pin-receiving member including one pin engaging surface 70 formed by the bridging member 28 and an opposing pin engaging surface 72 joined to pin engaging surface 70 by means of a bridge 74. Surfaces 70 and 72 are spring biased towards each other to provide a force fit for a respective first pin 4 when a pin 4 is inserted into the contact between surfaces 70 and 72 as depicted in FIGS. 1 and 2. In the embodiment of FIG. 4 the flange 42 is formed by the bridging member 28 and extends from the pin engaging surface 70. Referring to FIG. 4, the second means 32 includes a plurality of opposing pin contact surfaces 76 forming an opening 78 into which a respective second pin 8 extends. Pins 8 can be welded to adjacent surfaces 76 as shown generally at 80 in FIG. 4. Alternatively, pins 8 can be held in place by crimping surfaces 76.

In the structure thus far described above regarding FIGS. 1 to 4 a contact assembly is provided by means of which contact normal force is maintained by a compliant box operating between two contact points on a respective pin which allows for the automatic compression of pin thickness variability. In such structure the elongated contact 22 will float within the housing 12 to allow for automatic compensation of pin misalignment due to tolerance variation. The plastic housing 12 is not under stress and has no structural requirement to maintain contact normal force. Such structure is particularly useful in electronic systems requiring large numbers of electrical connections between printed wiring boards, the nature of the connection being such that the contact will exert enough force on the pin to establish a reliable electrical connection but the force will not be so large as to cause the resulting pin mating force to be so high as to preclude the mating of large numbers of contacts simultaneously.

Figure 5:
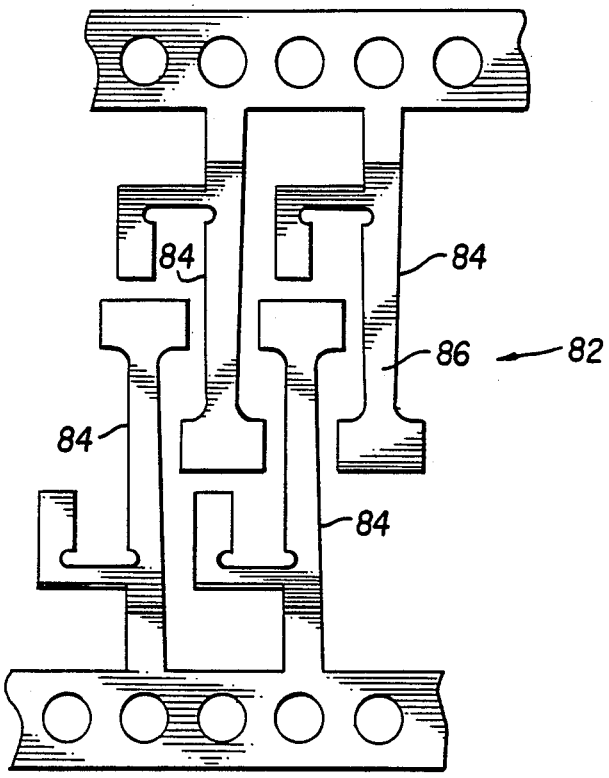
FIG. 5 is a partial plan view of the material used to form the elongated contacts of FIG. 4; and, FIG. 6 is a partial perspective view of the contact assembly of FIG. 1.

Referring to FIG. 5, a flat blank 82 permits an interleaving of blank elongated contact outlines 84. Such a layout yields an effective doubling of output with minimal material scrap loss. The embodiment of FIG. 5 permits the use of thin gage moderately priced copper alloys for the base contact material. If desired, preplated or inlaid flat stock material can be used to eliminate the need for subsequent plating operations.

If desired, assembly of the contact assembly 2 of the present invention can be postponed until final assembly of the connector. In assembling in this manner, individual elongated contacts 22 are dropped into respective cavities 14. Pins 8 are cut to the lengths required, inserted into a respective second entrance 18, and bent about a respective extended portion 50, 52, 54, 56. In this manner, only the mating portions of the contact and wire need to be inventoried as opposed to complete contacts of varying tail lengths as is presently the practice.

Figure 6:
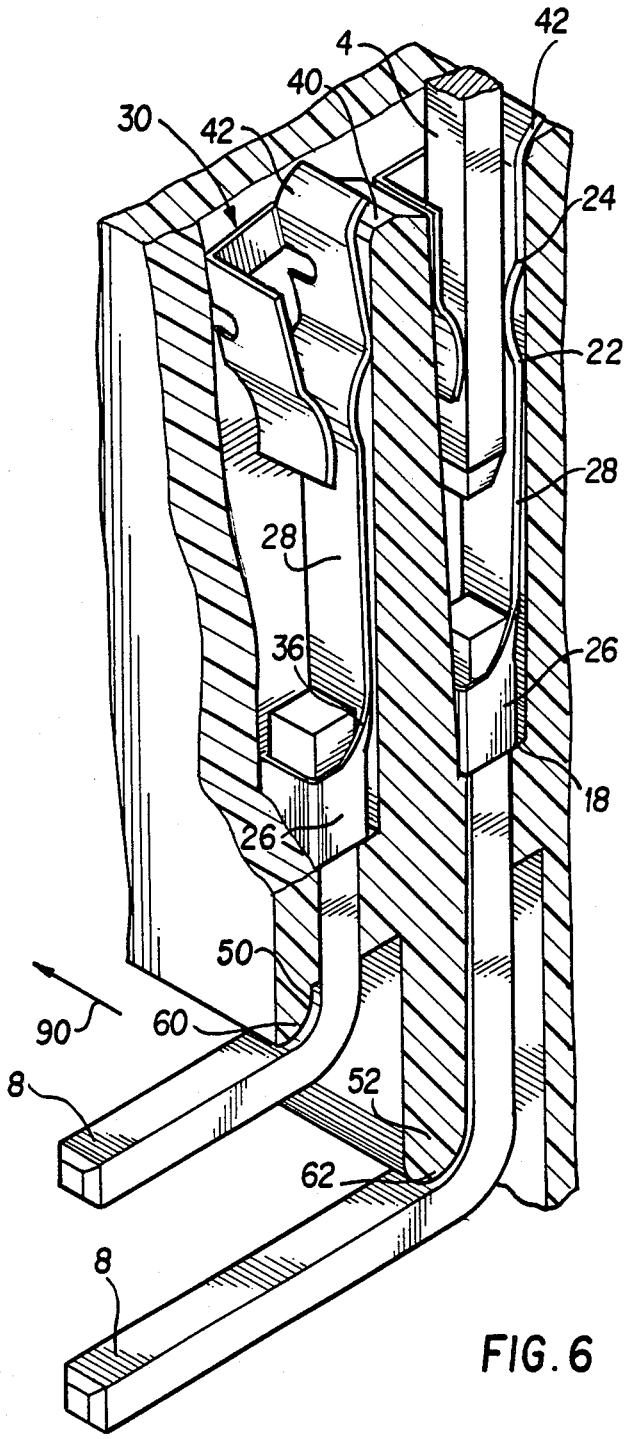

In the preferred embodiment, the housing 12 of the contact assembly 2 includes rows of equally spaced elongated cavities 14. FIG. 1 depicts one such row. Such rows can be equally spaced and caused to extend in the direction designated by arrow 90 of FIG. 6. In each row extended portions 50, 52, 54 and 56 extend across housing 12, in viewing FIG. 1, such that each second entrance 18 of each respective cavity 14 includes an extended portion extending from such second entrance. The extended portions 50, 52, 54 and 56 in each row are stepped downwardly as depicted in FIG. 1 from a front portion 92 of housing 12 to a rear portion 94 of housing 12.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A contact assembly for electrically conductively engaging at least one first pin at one end of said contact assembly and at least one second pin at an opposite end of said contact assembly, comprising:

a housing having at least one elongated cavity therein for receiving said at least one first pin at a first entrance to said cavity and said at least one second pin at an opposite second entrance to said cavity, said cavity extending along a longitudinal axis;

an elongated contact extending within said at least one elongated cavity along said longitudinal axis for electrically conductively engaging said at least one first pin at one end of said at least one elongated contact and said at least one second pin at an opposite end of said at least one elongated contact, said at least one elongated contact comprising:

a bridging member;

first means extending from a first end of said bridging member and forming said one end for electrically conductively engaging said at least one first pin so that when said at least one first pin is fully engaged by said one end said first means is substantially concentric relative to said longitudinal axis and said first pin, and when said first pin is not fully engaged by said one end said first means extends at an angle relative to said longitudinal axis; and, second means extending from a second end of said bridging member and forming said opposite end for electrically conductively engaging said second pin.

2. The contact assembly of claim 1 wherein said at least one elongated cavity includes a sidewall and said sidewall includes a first shoulder at said first entrance, and wherein said at least one elongated contact includes a flange at said one end of said at least one elongated contact, said flange being movable relative to said first shoulder such that when said first pin is fully engaged by said one end said first means is substantially concentric relative to said longitudinal axis and said first pin, and when said first pin is not fully engaged by said one end said first means extends at an angle relative to said longitudinal axis.

3. The contact assembly of claim 2 wherein said sidewall includes a second shoulder at said opposite second entrance and wherein said second means rests upon said second shoulder.

4. The contact assembly of claim 3 wherein said sidewall includes a plurality of opposite facing surfaces, respective of said opposite facing surfaces extending from said first entrance towards said second entrance at an angle relative to said longitudinal axis.

5. The contact assembly of claim 4 wherein said housing includes an extended portion extending from said housing at said second entrance, and further including said second pin electrically conductively attached to said second means, said second pin extending out of said at least one elongated cavity at said second entrance in a first direction along said longitudinal axis and being bent at an end of said extended portion to extend in a second direction which is at an angle to said longitudinal axis, said second pin thereby holding said at least one elongated contact in place within said at least one elongated cavity of said housing.

6. The contact assembly of claim 5 wherein said first means includes a U-shaped pin-receiving member including one pin engaging surface formed by said bridging member and an opposing pin engaging surface joined to said one pin engaging surface by means of a bridge, said one pin engaging surface and said opposing pin engaging surface being spring biased towards each other to provide a force fit for said first pin.

7. The contact assembly of claim 6 wherein said flange is formed by said bridging member and extends from said one pin engaging surface.

8. The contact assembly of claim 7 wherein said second means includes a plurality of opposing pin contact surfaces forming an opening into which said second pin extends.

9. The contact assembly of claim 8 wherein said second pin is welded to said second means at said plurality of opposing pin contact surfaces.

10. The contact assembly of claim 5 wherein said at least one elongated cavity includes at least one row of equally spaced elongated cavities, a second entrance of each of said equally spaced elongated cavities including a respective extended portion, said extended portions being stepped downward from a front portion of said housing to a rear portion of said housing.

11. The contact assembly of claim 10 wherein said first means includes a U-shaped pin-receiving member including one pin engaging surface formed by said bridging member and an opposing pin engaging surface joined to said one pin engaging surface by means of a bridge, said one pin engaging surface and said opposing pin engaging surface being spring biased towards each other to provide a force fit for said first pin.

12. The contact assembly of claim 11 wherein said flange is formed by said bridging member and extends from said one pin engaging surface.

13. The contact assembly of claim 12 wherein said second means includes a plurality of opposing pin contact surfaces forming an opening into which said second pin extends.

14. The contact assembly of claim 13 wherein said second pin is welded to said second means at said plurality of opposing pin contact surfaces.

15. A contact assembly for electrically conductively engaging first pins at one end of said contact assembly and second pins at an opposite end of said contact assembly, comprising:

a housing having a plurality of elongated cavities extending therethrough from said one end to said opposite end, each cavity extending along a respective longitudinal axis and being formed by at least one sidewall; and, an elongated contact extending within respective select elongated cavities of said plurality of elongated cavities along a respective longitudinal axis, each elongated contact comprising:

a bridging member having a first end spring biased towards said longitudinal axis;

first means extending from said first end of said bridging member for electrically conductively engaging a respective first pin so that when said respective first pin is fully engaged by said first means said first means is substantially concentric relative to said longitudinal axis and said respective first pin, and when said respective first pin is not fully engaged by said first means said first means extends at an angle relative to said longitudinal axis; and, second means extending from a second end of said bridging member for electrically conductively engaging a respective second pin.

* * * * *